United States Patent [19]

Römmen et al.

[11] Patent Number: 4,712,416

[45] Date of Patent: Dec. 15, 1987

[54] SIX-HIGH ROLL STAND WITH OFFSET INNER BACKUP ROLLS

[75] Inventors: Hans Römmen, Dormagen; Erich Stoy, Ratingen, both of Fed. Rep. of Germany

[73] Assignee: SMS Schloemann-Siemag AG, Dusseldorf, Fed. Rep. of Germany

[21] Appl. No.: 912,200

[22] Filed: Sep. 25, 1986

Related U.S. Application Data

[63] Continuation of Ser. No. 710,837, Mar. 12, 1985, abandoned.

[30] Foreign Application Priority Data

Mar. 13, 1984 [DE] Fed. Rep. of Germany ..... 3409162
Feb. 5, 1985 [DE] Fed. Rep. of Germany ..... 3503756

[51] Int. Cl.[4] ..... B21B 31/20; B21B 35/06

[52] U.S. Cl. ..... 72/241; 72/238; 72/243; 72/245; 72/249

[58] Field of Search ..... 72/241, 243, 245, 249, 72/238, 20

[56] References Cited

FOREIGN PATENT DOCUMENTS 3038865 12/1982 Fed. Rep. of Germany .
3335857 4/1985 Fed. Rep. of Germany .
3335858 4/1985 Fed. Rep. of Germany .
10341 1/1980 Japan ..... 72/241
947014 1/1964 United Kingdom ..... 72/243

*Primary Examiner*—Robert L. Spruill
*Assistant Examiner*—Steve Katz
*Attorney, Agent, or Firm*—Karl F. Ross; Herbert Dubno

[57] ABSTRACT

A six-high rolling stand has a pair of upper and lower working rolls defining a nip, a pair of upper and lower inner backup rolls vertically flanking and bearing on the working rolls, a pair of upper and lower outer backup rolls vertically flanking and bearing on the inner backup rolls, a frame, and respective journal blocks carrying the rolls in the frame and supporting the rolls therein for rotation about respective axes that are all substantially parallel with the outer roll axes at least defining a vertical plane. A drive is connected directly to the outer backup rolls for oppositely rotating same and the upper and lower rolls vertically engage one another so that the rotation of the outer backup rolls is transmitted through the inner backup rolls to the working rolls. Actuators braced between some of the journal blocks and the frame for vertically displacing at least some of the rolls horizontally perpendicular to the plane. These actuators are braced between the journal blocks of the inner backup rolls and the frame for displacing the inner rolls and the respective axes horizontally perpendicular to the plane to a position offset horizontally therefrom.

8 Claims, 10 Drawing Figures

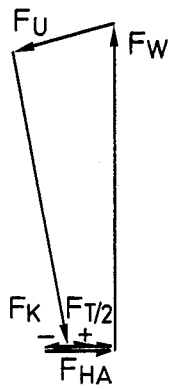
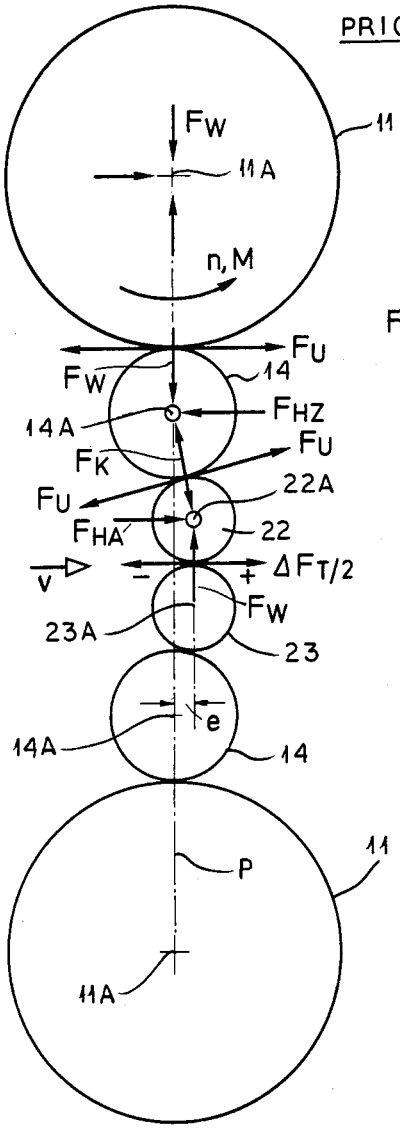
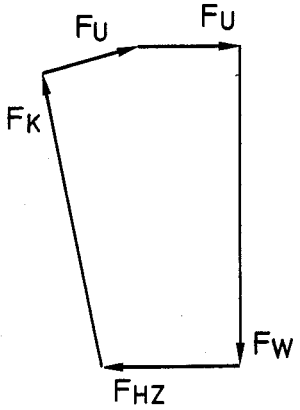
Fig. 6
PRIOR ART
Fig. 2

Fig. 7
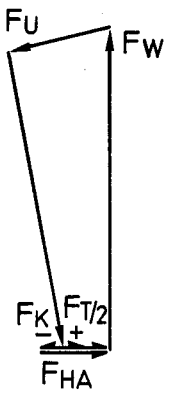
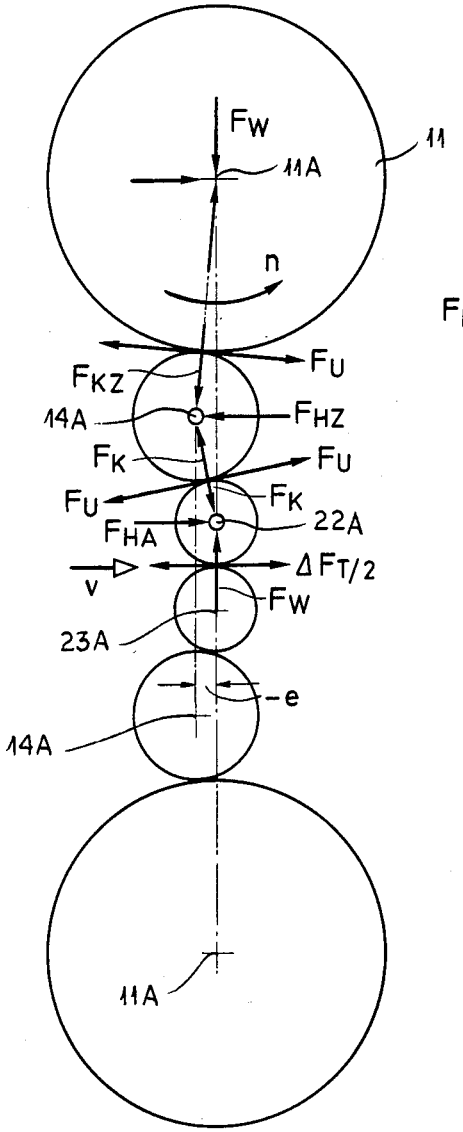
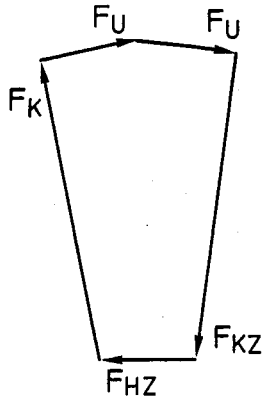
Fig. 8
Fig. 3

Fig. 9
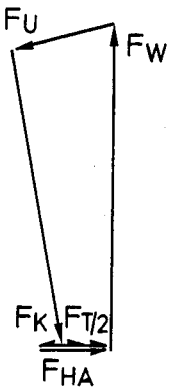
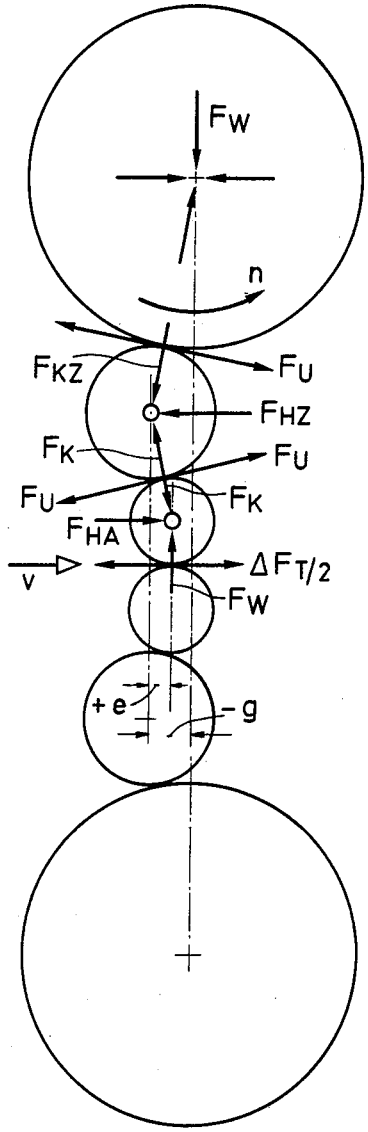
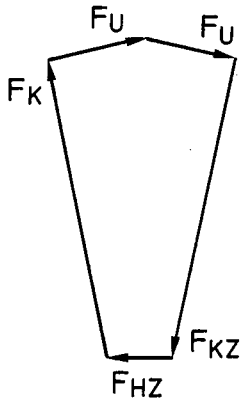
Fig. 10
Fig. 4

SIX-HIGH ROLL STAND WITH OFFSET INNER BACKUP ROLLS

This is a continuation of co-pending application Ser. No. 710,837, filed on Mar. 12, 1985, now abandoned.

FIELD OF THE INVENTION

The present invention relates to a roll stand. More particularly this invention concerns a six-high stand of the type used in rolling strip steel.

BACKGROUND OF THE INVENTION

A standard six-high rolling stand of the type used for rolling strip steel has a pair of vertically spaced nip-defining working rolls of relatively small diameter. Respective upper and lower inner backup rolls of larger diameter bear respectively down and up toward the nip on the respective working rolls, and respective upper and lower outer backup rolls of still larger diameter bear toward the nip on the respective inner backup rolls. Thus the bendability of the small-diameter working rolls is largely canceled out by the rigidity of the larger-diameter backup rolls so that the large forces required for rolling can be brought to bear on the workpiece.

As described in "Herstellung von kaltgewalztem Band" (Volume 1 Verlag Stahleisen mbH, Dusseldorf, 1970, p309 and 310) working rolls of the smallest possible diameter are used for the most concentrated working effect. Lower limits are placed to the working roll size by such factors as the rolling and reaction forces that are transmitted as well as the angular forces that flow from the driven outer backup rolls. In addition the size of the stub shafts of the working rolls limits the amount of transverse stress that can be withstood, and the roll size itself determines when it will bend if stressed too much.

Accordingly it is known to brace the working rolls horizontally. German patent documents Nos. 3,335,857 and 3,335,858 describe systems that shift the working rolls axially, and so-called bottle rolls are used in German patent No. 3,038,865 require that the inner backup rolls be driven, a problem greatly complicated by the telescoping connection to the backup-roll ends. Thus it is standard to drive the outer backup rolls and have this rotation transmitted through the inner backup rolls to the working rolls. Passing such angular force through the inner backup rolls subjects them to bending stresses while greatly loading their bearings.

OBJECTS OF THE INVENTION

It is therefore an object of the present invention to provide an improved six-high roll stand.

Another object is the provision of such a six-high roll stand which overcomes the above-given disadvantages, that is which can be used with driven outer backup rolls without subjecting the inner rolls to excessive wear.

A further object is to provide an improved method of rolling and method of operating a six-high roll stand.

SUMMARY OF THE INVENTION

A six-high rolling stand according to the invention has, as is known, a pair of upper and lower working rolls defining a nip, a pair of upper and lower inner backup rolls vertically flanking and bearing on the working rolls, a pair of upper and lower outer backup rolls vertically flanking and bearing on the inner backup rolls, a frame, and respective journal blocks carrying the rolls in the frame and supporting the rolls therein for rotation about respective axes that are all substantially parallel with the outer roll axes at least defining a vertical plane. A drive is connected directly to the outer backup rolls for oppositely rotating same and the upper and lower rolls vertically engage one another so that the rotation of the outer backup rolls is transmitted through the inner backup rolls to the working rolls. Actuators are braced between some of the journal blocks and the frame for vertically displacing at least some of the rolls horizontally perpendicular to the plane. According to this invention these actuators are braced between the journal blocks of the inner backup rolls and the frame for displacing the inner rolls and the respective axes horizontally perpendicular to the plane to a position offset horizontally therefrom.

By this simple expedient it is possible with stationary working rolls to achieve a controllable compensation of the angular and transverse forces effective on the working rolls as well as on the differential forces caused by the tension upstream and downstream in the workpiece. Since in a six-high roller the rolling forces are the same as the angular forces, the angular compensation depends on the radii of the rolls being used, so that the desired overall compensation effect is achieved for the working rolls concomitantly with a compensation of the forces effective on the inner backup rolls.

In accordance with further features of this invention the actuators are mechanical and include means for synchronizing the horizontal movement of the inner roll axes with each other. Such actuators have horizontally effective screw-type jacks braced against the inner-roll journal blocks and driven by a common worm gear. They can also be hydraulic, in which case the synchronizing movements can either include a vertical link connected between the inner backup rolls, or means for permitting some relative horizontal movement of the inner roll axes.

The system of this invention also has respective guide elements vertically fixed to the journal blocks and respective holding blocks carried by the actuators and supporting the respective guide elements for limited relative vertical movement.

It is also within the scope of this invention to offset the working rolls and the respective axes horizontally perpendicular to the plane to a position offset horizontally therefrom and lying between the plane and the axes of the inner backup rolls. This is done by the use of spacers of different widths supporting the working-roll journal blocks in the frame.

The method according to the invention therefore comprises the steps of rotatably driving the outer backup rolls about their axes and thereby counterdirectionally rotating the respective inner backup rolls and codirectionally rotating the respective working rolls, the rotation directions for the outer backup rolls being opposite, pulling a workpiece to be rolled horizontally and substantially perpendicular to the planes through the nip in a predetermined direction, pressing the rolls vertically toward the nip to squeeze the workpiece, and offsetting the inner plane of the inner backup rolls in the direction from the outer plane.

BRIEF DESCRIPTION OF THE DRAWING

The above and other features and advantages will become more readily apparent from the following, reference being made to the accompanying drawing in which:

FIG. 2 is a force diagram illustrating the forces in a prior-art system;

FIG. 3 is a force diagram illustrating the forces in the system according to this invention;

FIG. 4 is a force diagram like FIG. 3 but showing another arrangement in accordance with this invention;

FIGS. 5 and 6 are the vector diagrams for the working and inner-backup rolls, respectively, of the prior-art arrangement of FIG. 2;

FIGS. 7 and 8 are the vector diagrams for the working and inner-backup rolls, respectively, of the arrangement of FIG. 3; and FIGS. 9 and 10 are the vector diagrams for the working and inner-backup rolls, respectively, of the arrangement of FIG. 4.

SPECIFIC DESCRIPTION

Figure 1:
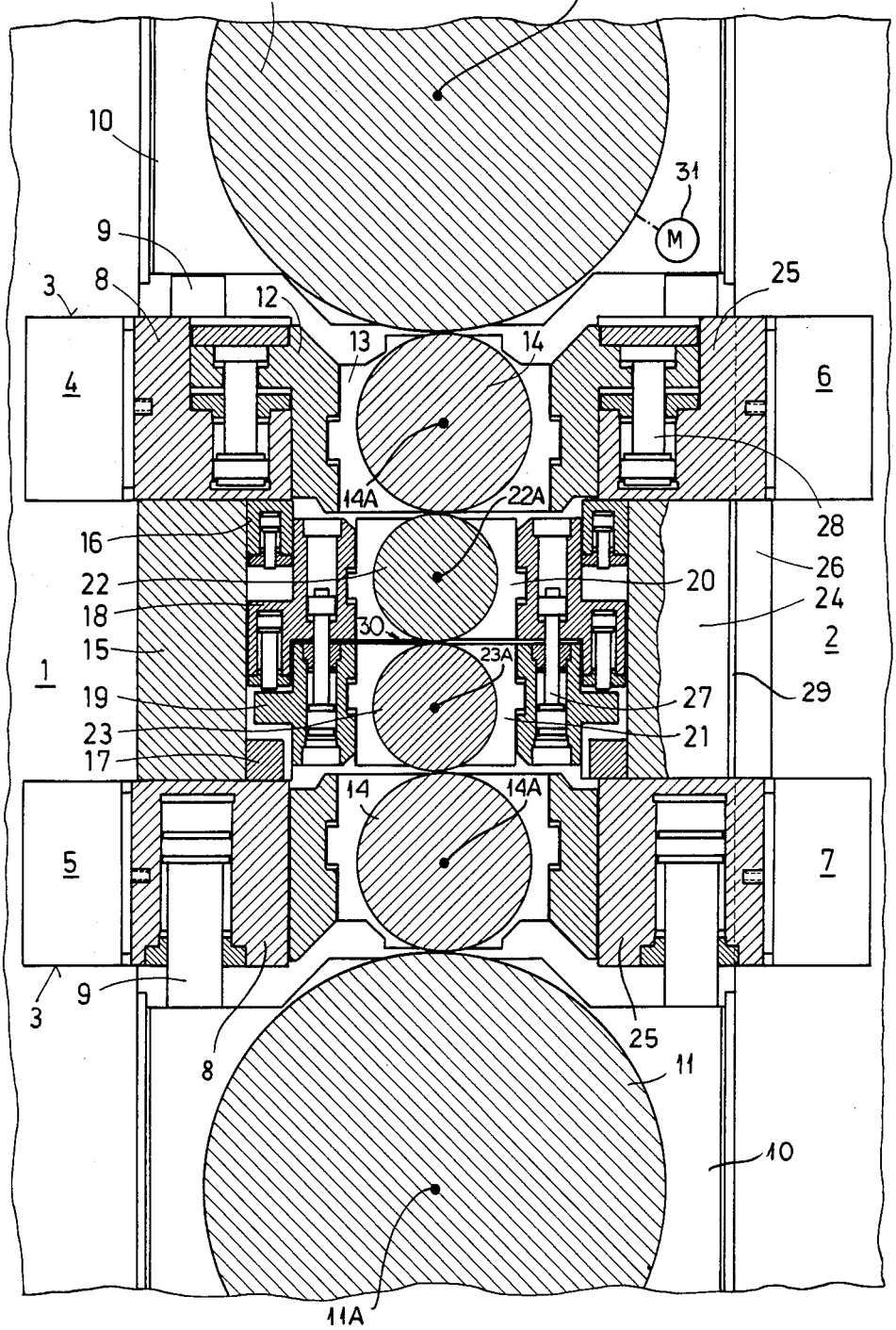
FIG. 1 is a partly diagrammatic vertical section through a six-high roll stand according to the invention.

As seen in FIG. 1 a six-high roll stand has a roll housing or frame 1, 2 provided with two working rolls 22 and 23, two inner backup rolls 14, and two outer backup rolls 11 rotated by a schematically illustrated drive 31 about respective axes 22A and 23A, 14A, and 11A that are parallel to one another and vertically spaced. The upper and lower outer backup rolls 11 are supported by standard bearings at their ends in respective journal blocks 10 mounted directly in the housing 1. Unillustrated hydraulic rams engage the two journal blocks 10 of the upper outer backup roll 6 and thereby exert the principal force on a workpiece passing through a nip 30 defined between the confronting edges of the working rolls 22 and 23.

The working rolls 22 and 23 have journal blocks 20 and 21 that have axially extending guide bars so as to be vertically nondisplaceable but axially slidable relative to respective guide elements 18 and 19 with which the guide bars or ridges fit. Guide bars 16 and 17 fixed in the housing 1, 2 limit the vertical displacement of these blocks 18 and 19. These elements 18 and 19 in turn are vertically shiftable relative to mounting blocks 15 and 24 fixed in the housing 1, 2 at the level of the working rolls 22 and 23. Double-acting actuators 27 can vertically displace these rolls 22 and 23 relative to each other. Thus it is possible to slide the rolls 22 and 23 out of the housing 1, 2 parallel to their axes 22A and 23A to change them.

Similarly the upper and lower inner backup rolls 14 have respective journal blocks 13 having axially extending guide bars engaging in respective guide elements 12 so that these blocks 13 are vertically nondisplaceable but axially slidable relative to the respective guide elements 12. Thus the inner backup rolls 14 also can be changed by pulling them axially out of the machine. The guide blocks 12 in turn are limitedly vertically displaceable in respective holding blocks 8 and 25 carried on respective horizontal actuators 4, 5, 6, and 7 received in horizontally open pockets 3 formed in the frame 1, 2. Actuators 28 allow the vertical position of the upper guide elements 12 to be set relative to the upper holding blocks 8. The holding blocks 8 and 25 are braced by further vertically double-acting hydraulic actuators 9 against the mounting blocks 10.

The actuators 4 and 5 can be of the standard heavy-duty hydraulic type. The actuators 6 and 7 are of the worm-drive type described in German patent document No. 3,335,858. In addition the blocks 25 are vertically interconnected by rigid links 26 that ensure that they will move perfectly synchronously horizontally. These links 26 pass through appropriate cutouts 29 in the holding blocks 24 of the working rolls 22 and 23.

In FIGS. 2 through 10 the diagrams use the following common notation:

v=the horizontal direction of displacement of the workpiece through the nip 30;

n, M=the rotation direction of the upper outer backup roll resulting from workpiece displacement in direction v, which direction is the same for the upper working roll;

$F_U$=the angular force between the rolls;

$F_{HZ}$=the horizontal force applied to the journal blocks of the intermediate backup rolls;

$F_{HA}$=the horizontal force applied to the journal blocks of the working rolls;

$F_T$=the difference between the upstream and downstream tension of the workpiece;

$F_W$=vertical rolling pressure; and $F_K$=reaction force.

In FIG. 2 the six rolls 22, 23, 14, and 11 of a standard prior-art stand are shown, with the axes 11A and 14A defining a vertical plane P and the axes 22A and 23A defining a parallel plane P offset therefrom in the direction by a distance e. The force differential $F_T$ is split between the working rolls 22 and 23 and can be positive (in the direction v) or negative. FIGS. 5 and 6 show the force diagrams for the roll 22 and for the upper roll 14, with the rolling force $F_W$ and the angular force $F_U$ being equal.

As seen in FIG. 5, since the working rolls 22 and 23 are offset from the plane P, the angular force $F_U$ as well as the reaction force $F_K$ are at an acute angle to the rolling force $F_W$ so that the head of the vector $F_K$ approaches the starting point of the rolling vector $F_W$ and the horizontal force $F_{HA}$ is reduced relative to the resultant of the perpendicular force $F_U$ and force $F_K$. By varying the spacing e various levels of compensation can be set, but in any case the horizontal force $F_{HA}$ is substantially smaller than the actual force $F_U$ originally applied to the rolls. According to the spacing e, the force $F_{HA}$ varies between 0 and 0.5 $F_U$ with the force $F_{HA}$ being set at any desired level.

FIG. 6 illustrates that for the inner backup rolls 14 there is little compensation effect, as only a portion of the angular force $F_U$ which is doubly effective on these rolls 14 can be compensated out. One of the forces $F_U$ is perpendicular to the rolling force $F_W$ and the other is at an acute angle due to the offset e so the force diagram tapers downward and only slightly reduces the horizontal force $F_{HA}$. Thus no matter what settings are used by this prior-art system, the inner backup rolls are subjected to quite some bending stresses and even the position of these rolls determines this stress. Since the rolling force $F_W$ itself is only transmitted by the rolls 14, it should take place without excess loading.

According to the invention as shown in FIG. 3 the working-roll axes 22A and 23A lie in the plane P of the outer-roll axes 11A but the plane P' of the inner axes 14A is offset by e against the workpiece travel direction v. Here the angular force $F_U$ transmitted from the drive to the rolls 14 is reduced by the horizontal component of the rolling force $F_W$ so that only a controllable remainder directed at the inner roll is left and the working roll is unloaded so that even though it is of reduced diameter it is stable and neither bends nor vibrates. The extent of compensation is established by the position set by the actuators 4 through 7. At the same time there is an corresponding shift through the offset e relative to the backup roll so that as shown in FIG. 8 the inner backup roll receives the reaction force $F_{KZ}$ at an angle opposite to that of the force $F_K$ thereby reducing the component $F_{HZ}$ and thereby greatly relieving the journal blocks 13. It cannot be wholly compensated out without overcompensating the working roll 22, because the sum of the radii of the backup rolls is greater than that of the working roll and of the inner backup roll. The force diagram of the working roll according to FIG. 7 is the same as that of FIG. 5. Thus according to the setting of the offset −e (the negative sign indicating against the travel direction v), the horizontal stress $F_{HA}$ is set between 0 and 0.5 $F_U$ while with normal radii the horizontal force of the inner rolls $F_{HZ}$ is between 0.5 $F_U$ and 1.0 $F_U$.

FIG. 4 shows a further modification according to the invention. Here the inner backup rolls 14 are moved −g in the direction v and the working rolls 22 and 23 are moved through a shorter offset −e. The effect on the working roll 22 as shown in FIG. 9 remains the same, but this extra offset tapers the diagram of FIG. 10 even more, showing how greatly the horizontal component $F_{HZ}$ can be reduced. Since the force $F_{HZ}$ performs no useful work in the process, but merely serves to generate unnecessary heat in the roll bearings, such reduction increases machine efficiency considerably.

The desired effect can be provided by using the actuators 4 through 7, and by employing differently sized spacer blocks 15 and 24, as once the offset for the working rolls 22 and 23 is established fine adjustment can be achieved with these actuators 4 through 7. It is also of course possible to fix the positions of the inner backup rolls, and to displace the working rolls for fine adjustment. This style of operation allows the force $F_{HA}$ to be controlled accurately so that small diameter working rolls can be employed without bending.

We claim:

1. In a six-high rolling stand comprising:

a pair of upper and lower working rolls defining a nip and having respective axes lying in a vertical working-roll plane;

a pair of upper and lower inner backup rolls vertically flanking and bearing on the working rolls, said inner backup rolls having respective axes lying in a vertical inner-backup-roll plane;

a pair of upper and lower outer backup rolls vertically flanking and bearing on the inner backup rolls, said outer backup rolls having respective axes lying in a vertical outer-backup-roll plane;

a frame;

respective journal blocks carrying the rolls in the frame and supporting the rolls therein for rotation about the respective axes so that all of said axes are substantially parallel;

drive means connected directly to the outer backup rolls for oppositely rotating same, the upper and lower rolls vertically engaging one another, whereby the rotation of the outer backup rolls is transmitted through the inner backup rolls to the working rolls; and actuator means braced between some of the journal blocks and the frame for displacing at least some of the rolls horizontally perpendicular to the planes, the improvement wherein the actuator means are braced between the journal blocks of the inner backup rolls and the frame and are provided with means enabling them to be continuously adjusted for displacing the inner backup rolls and the respective axes horizontally perpendicular to said planes to a position in which said inner-backup-roll plane is offset horizontally from said outer-backup-roll plane and said working-roll plane is offset from both said backup-roll planes and is located between said backup-roll planes.

2. The six-high roll stand defined in claim 1 wherein the actuator means are mechanical and include means for synchronizing the horizontal movement of the inner roll axes with each other.

3. The six-high roll stand defined in claim 1 wherein the actuator means are hydraulic and include means for synchronizing the horizontal movement of the inner roll axes with each other.

4. The six-high roll stand defined in claim 3 wherein the synchronizing means includes link means for permitting limited relative horizontal movement of the inner roll axes.

5. The six-high roll stand defined in claim 1, further comprising respective guide elements vertically fixed to the journal blocks of said upper and lower inner backup rolls; and respective holding blocks carried by the actuators and supporting the respective guide elements for limited relative vertical movement.

6. The six-high roll stand defined in claim 5, further comprising a rigid vertical link extending between holding blocks of the upper and lower outer backup rolls.

7. In a six-high rolling stand comprising:

a pair of upper said lower working rolls defining a nip and having respective axes defining a vertical working-roll plane;

a pair of upper and lower inner backup rolls vertically flanking and bearing on the working rolls, said inner backup rolls having respective axes defining a vertical inner-backup-roll plane;

a pair of upper and lower outer backup rolls vertically flanking and bearing on the inner backup rolls, said outer backup rolls having respective axes defining a vertical outer-backup-roll plane;

a frame;

respective journal blocks carrying the rolls in the frame and supporting the rolls therein for rotation about the respective axes such that all of said axes are substantially parallel;

drive means connected directly to the outer backup rolls for oppositely rotating same, the upper and lower rolls vertically engaging one another, whereby the rotation of the outer backup rolls is transmitted through the inner backup rolls to the working rolls;

actuator means braced between some of the journal blocks and the frame for displacing at least some of the rolls horizontally perpendicular to the planes, the improvement wherein:

the actuator means are braced between the journal blocks of the inner backup rolls and the frame and are constructed to be continuously adjusted for displacing the inner backup rolls and the respective axes horizontally perpendicular to said planes to a position in which said inner-backup-roll plane is offset horizontally from said outer-backup-roll plane; and means is provided for offsetting the working rolls and the respective axes horizontally perpendicular to said planes to a position in which said working-roll plane is offset horizontally from said backup-roll planes and lies between the outer-backup-roll plane and the inner-backup-roll plane.

8. The six-high roll stand defined in clalim 7 wherein the means for offsetting the working rolls includes spacers of different widths supporting the working-roll journal blocks in the frame.

* * * * *